US005595309A

United States Patent [19]

Bauer et al.

[11] Patent Number: 5,595,309

[45] Date of Patent: Jan. 21, 1997

[54] PEGHOOK WITH CORRUGATED DISPLAY PANEL

[75] Inventors: Jamie D. Bauer, Edgewater, N.J.; John P. Krisko, Danbury, Conn.

[73] Assignee: Advertising Display Company, Englewood Cliffs, N.J.

[21] Appl. No.: 391,450

[22] Filed: Feb. 21, 1995

[51] Int. Cl.[6] ..... B42F 15/00

[52] U.S. Cl. ..... 211/59.1; 248/220.31

[58] Field of Search ..... 211/59.1, 94, 94.5, 211/118, 119, 57.1, 87, 113; 248/220.31, 220.21, 220.22, 220.41, 220.42, 220.43, 221.12, 222.41, 223.21, 223.31, 304; 40/655, 657, 659

[56] References Cited

U.S. PATENT DOCUMENTS

| | | | |
|---|---|---|---|
| 3,255,987 | 6/1966 | Gatch | 248/220.31 |
| 3,425,889 | 2/1969 | Willits, Jr. | 248/220.43 |
| 3,433,365 | 3/1969 | Hodson | 248/220.314 |
| 3,483,995 | 12/1969 | Larson | 248/220.41 |
| 3,918,668 | 11/1975 | Thorpe | 211/59.1 X |
| 4,860,905 | 8/1989 | Schott et al. | 248/220.31 X |
| 4,865,205 | 9/1989 | Thorneburg et al. | 211/59.1 |
| 5,429,334 | 7/1995 | Hutchison | 211/59.1 X |

*Primary Examiner*—Ko Chan
*Assistant Examiner*—Sandra Snapp
*Attorney, Agent, or Firm*—Donald R. Heiner, Esq.

[57] ABSTRACT

A corrugated board display panel with peghooks wherein the peghooks are installed from the rear of the panel. With peghooks in place in the main panel side wings are folded along scored creases permanently encasing peghook bases which remain on the rear side of the corrugated display panel. The side wings are then permanently affixed to the main panel with staples or glue or any other convenient fastening means. The peghooks then project outwardly and forward through slots in the main display panel and at an upward angle of tilt.

5 Claims, 3 Drawing Sheets

PEGHOOK WITH CORRUGATED DISPLAY PANEL

BACKGROUND OF INVENTION

1. Field of the Invention

The present invention generally involves the field of technology pertaining to a display panel and hook associated therewith for displaying packages such as at the point of purchase.

The corrugated board display panel of the instant invention has a main center panel and two side wings, one on each side of the center panel, and a plurality of slots formed therethrough for receiving and holding peghooks which are inserted through the rear of the panel rather than through the front as is currently being done.

Scored creases separate the side wings from the center panel and allow the side wings to be folded over against the back side of the main panel holding a base portion of the peghook in place. The side wings are then secured in this position to the main center panel by any well known means such as by staples, glue, or the like.

2. Description of the Prior Art

In a prior filed and co-pending application titled "Peghook", applicant cited prior art in regard to the peghook itself and applicant is unaware of any pertinent prior art pertaining to such a peghook in the environment of the peghook panel of the instant invention.

SUMMARY OF THE INVENTION

According to the present invention there is provided a corrugated board display panel having injection molded peghooks associated therewith for displaying packaged goods especially at a point of purchase. The display board itself comprises a main center panel and two adjacent side wings wherein scored creases separate the side wings from the main center panel which allow the side wings to be folded over against the back side of the main panel. The side wings can then be secured in this position to the main center panel by any well known means. A plurality of slots are formed through the display panel for insertion of the peghooks.

The peghook shaft has an elliptical cross section with its long axis running horizontally. This design prevents notching of film packages in a prepacked display from stress encountered during shipping. This is especially true and useful when utilized with film packaging having a very low notch resistance which is often used by manufacturers to facilitate ease of opening for the end user of the product. Notch prevention is accomplished by increasing the contact arc between the top surface of the hook shaft and the edge of the punched hole in the package.

The peghook has a back plate having an upper vertical, planar surface coupled with a lower angular, planar surface.

Barbed fins associated with the peghook on the side away from the installer and an I-shaped connecting structure registers the peghooks with the corrugated panel which enables the hooks to be held in position, temporarily, as inserted.

After the peghooks are inserted into the corrugated panel and the side wings of the panel are folded along the scored creases as previously indicated, the hook bases are permanently held on the rear side of the corrugated display panel.

In this position the lower angular surface of the peghook is pressed between the main panel and the side wings whereby pressure is applied upwardly to the hook shaft maintaining an upward angle of tilt of approximately 15 degrees or any other desired degree of tilt. This upward tilt enables the molded hook shaft to compensate for material loading and creep when the hooks are filled with the products to be displayed.

This same lower angular surface of the hook base also comprises a small barb at its lowermost edge which faces rearwardly and pierces, slightly, the surface of the corrugated wing thereby prohibiting or preventing movement of the hook with respect to its mating slot, especially rotational movement.

An I-shaped structure holds the shaft portion of the peghook to the hook base.

It is therefore an object of the present invention to provide a corrugated board display panel with peghooks wherein the peghooks are installed from the rear of the panel.

It is another object of the invention to provide a corrugated board display panel with peghooks wherein the corrugated board display panel comprises a main center panel and two side wings, on each side of the center panel.

It is a further object of the invention to provide a corrugated board display panel with peghooks wherein, with the peghooks in place in the main panel, the side wings are folded along scored creases permanently encasing the peghook on the rear side of the center display panel.

It is still a further object of the invention to provide a corrugated board display panel with peghooks wherein the side wings are permanently affixed to the main panel with staples or glue or any other convenient fastening means.

It is still another object of the invention to provide a corrugated board display panel with peghooks wherein the peghooks, in place on the panel, project outward and forward through slots in the main display panel and at an upward angle of tilt.

These and other objects, features and advantages of the invention shall become apparent from the following detailed description of a preferred embodiment thereof when taken in conjunction with the drawings wherein like reference characters refer to corresponding parts in the several views.

DETAILED DESCRIPTION OF THE PREFERRED EMBODIMENT

A corrugated board display panel with peghooks for displaying merchandise at a point of purchase wherein the peghook can be inserted into the slots of the panel from the back wherein the peghooks are then encased between the main center portion of the panel and two side wings folded over against the back of the center portion of the panel as will now be described with reference to FIGS. 1–7 of the drawings.

Figure 4:
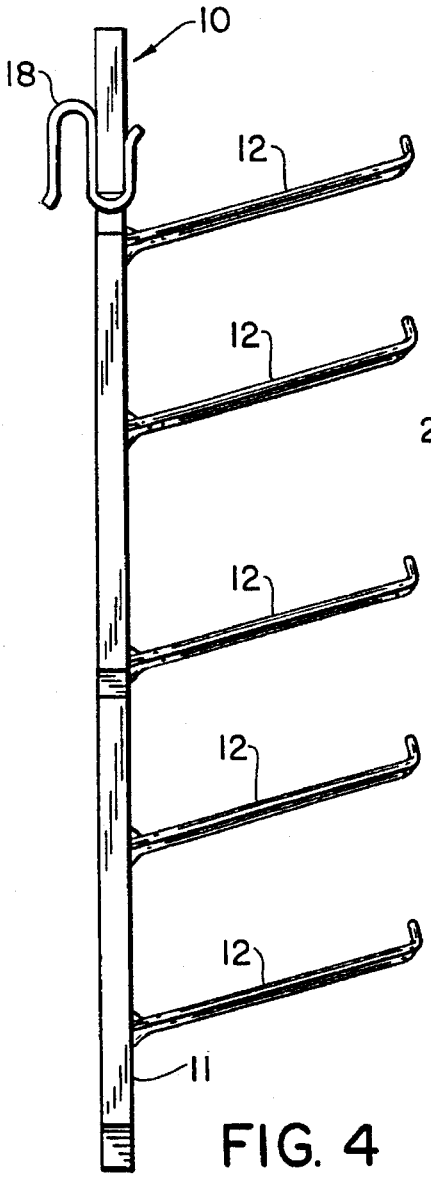
FIG. 4 is a side view of the panel showing the peghooks in place.
Figure 6:
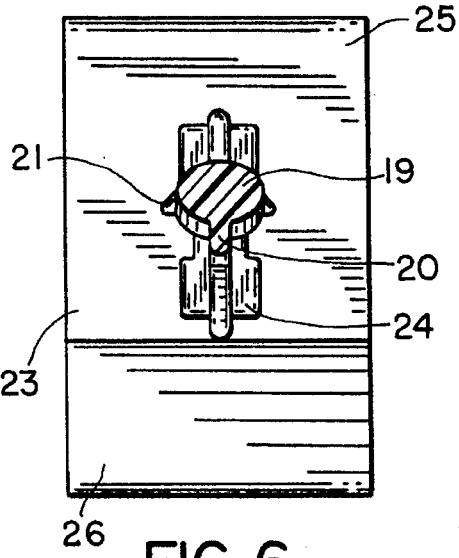
FIG. 6 is a cross sectional view taken on line 6—6 of FIG. 5.
Figure 7:
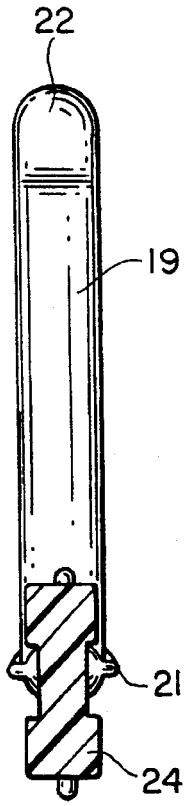
FIG. 7 is a cross sectional view taken on line 7—7 of FIG. 5.

The corrugated board display panel with peghooks in place is shown generally at 10 in FIG. 4 and is seen comprising corrugated board display panel 11 and peghooks 12. The peghooks 12 receive packaged goods to be displayed at a point of purchase.

Figure 1:
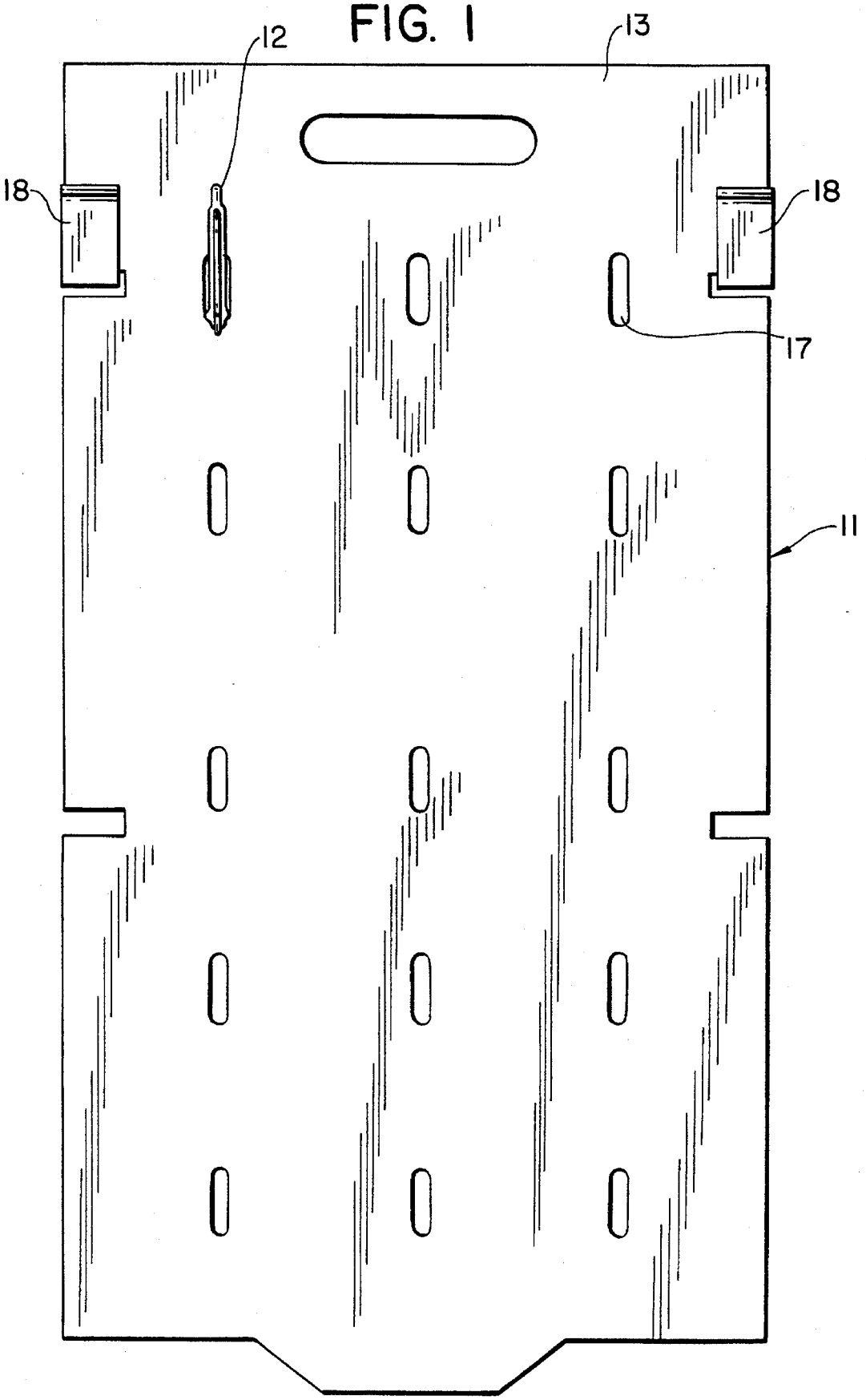
FIG. 1 is a front view of the corrugated board display panel showing the main center panel only.
Figure 3:
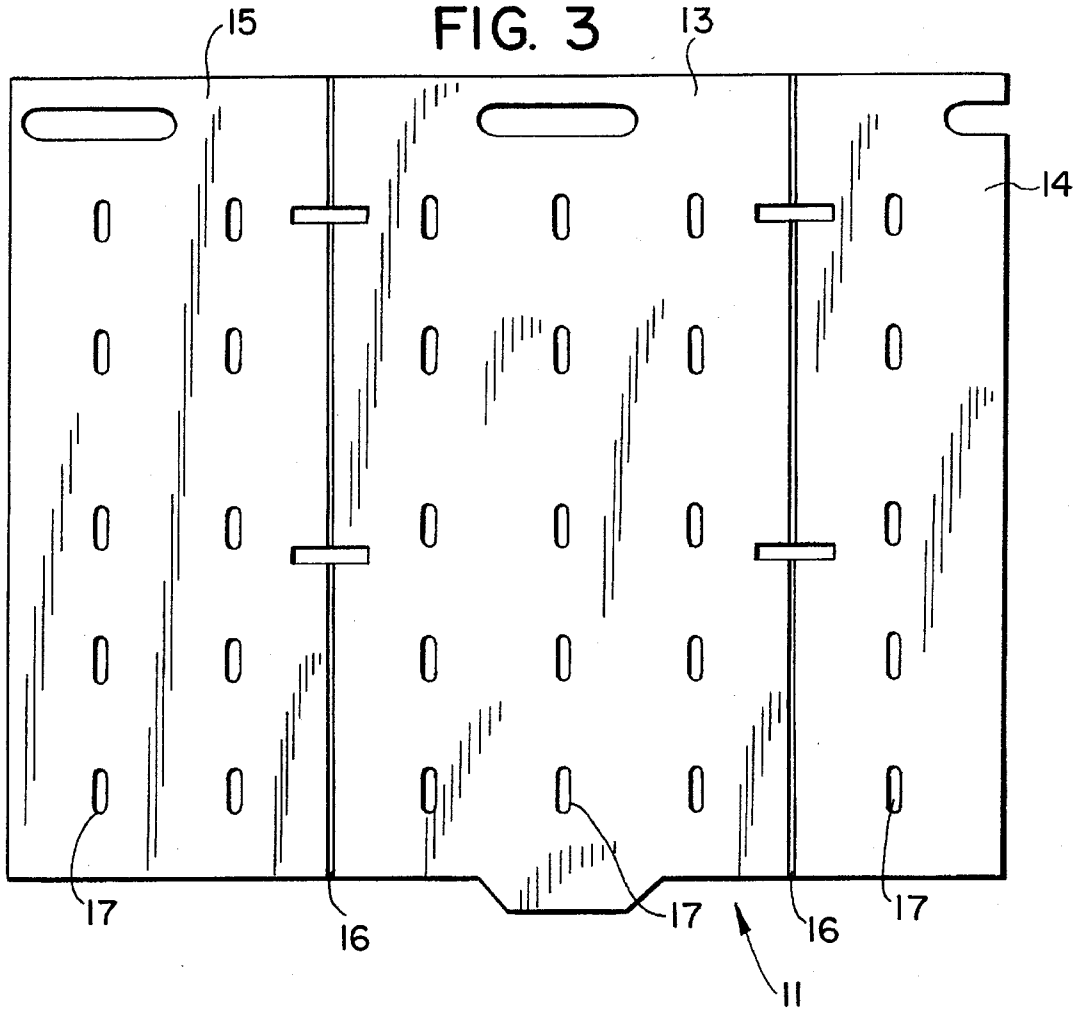
FIG. 3 is a front view of the panel showing the center panel and two side wings unfolded.
Figure 2:
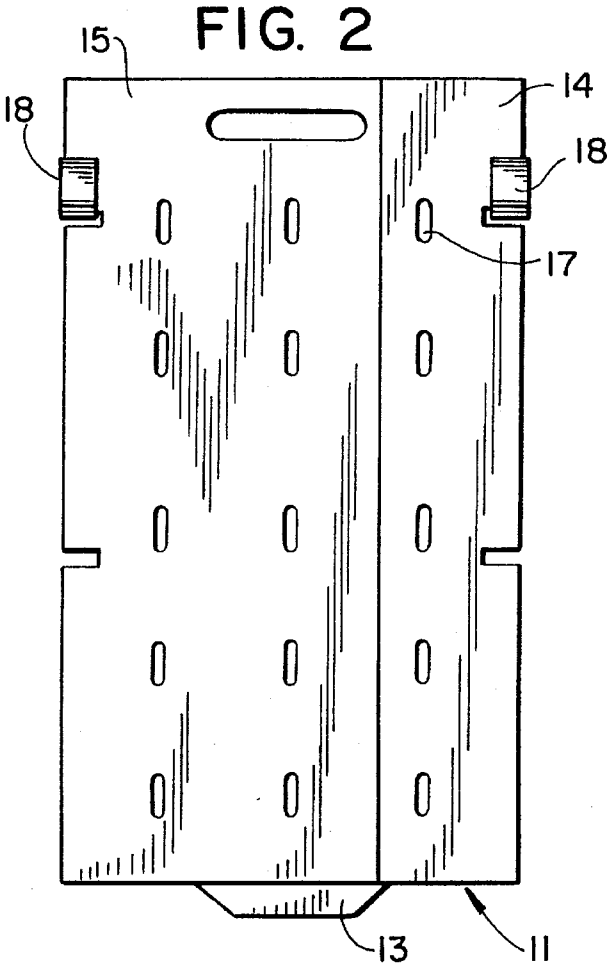
FIG. 2 is a rear view of the panel showing the two side wings folded over the back of the panel.

The corrugated board display panel 11 comprises a center panel 13 and side wings 14 and 15 as best seen in FIG. 3. FIG. 1 shows a front view of center panel 13 with side wings 14 and 15 folded backwards over against the rear of center panel 13. FIG. 2 shows a rear view of the center panel 13 with side wings 14 and 15 folded over and FIG. 3 shows the center panel 13 and side wings 14 and 15 in an unfolded position. Fold scores 16 extend vertically between the center panel and side wings to facilitate the folding of the side wings relative to the center panel.

The center panel and side wings further comprise a plurality of slots 17 for receiving peghooks 12 and for assisting in holding them in place and at an upward angle of tilt as will be further described below. "S" clips 18 are strategically placed on the panels for securing the completed display panel with peghooks to a slotted support base not shown. The "S" clips are placed conveniently to accommodate the slots in such a support base.

Figure 5:
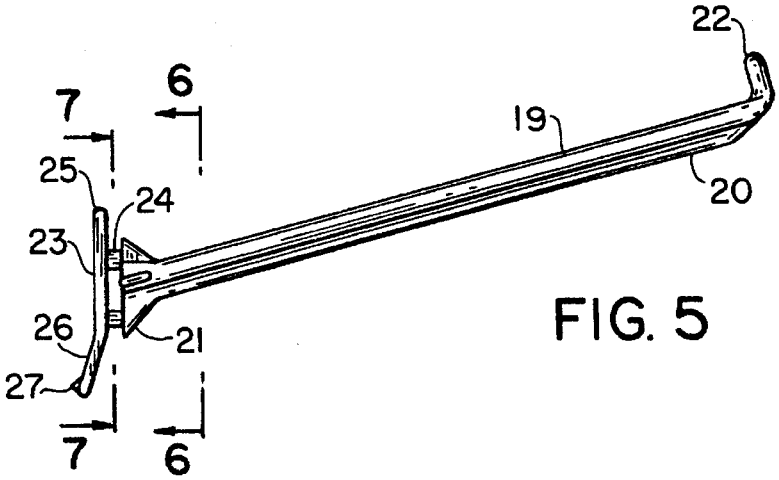
FIG. 5 is a side view of the peghook showing the back plate and I-connector.

Peghooks 12 to be inserted into slots 17 of corrugated board display panel 11 have a generally horizontally extending elliptically shaped shaft 19 with reinforcing rib 20 as best seen in FIG. 5. A plurality of barbs 21 are formed around the circumference of the shaft 19, at one end thereof, for purposes to be more fully described below. The horizontal shaft 19 terminates at one end, distant from barbs 21, with a hook 22 for receiving packaged goods to be held by the horizontal shaft of the peghooks, in the display panel, at the point of purchase.

A hook base 23 is attached to the end of the horizontal shaft 19, distant from the hook 22, and at the barbed end, by means of an I-shaped connecting structure 24 for purposes to be more fully described below.

The hook base 23 has an upper, vertical planar surface 25 and a lower angular, planar surface 26 with a small barb 27 at its lower most edge and facing rearward as best seen in FIG. 5. This small barb 27 slightly pierces the surface of the rearwardly folded corrugated wings to aid in preventing movement of the peghook, especially rotational movement, of the peghook 12 with respect to its mating slot 17 in the panel.

In operation, with the display panel in its unfolded condition as shown in FIG. 3 peghooks 12 are inserted into slots 17 of center panel 13 through the rear side thereof whereby barbs 21 and I-shaped connecting structure 24 register the peghooks with the corrugated board display panel enabling the peghooks 12 to temporarily be held in position as inserted.

With the peghooks now in the slots of the center panel the side wings 14 and 15 are folded on the fold scores 16 against the rear of center panel 13 thereby pressing against hook base 23 of peghook 12 thereby causing, by virtue of the lower, angular surface, of hook base 23, an upward tilt to the peghooks. The side wings are then permanently secured to the center panel by means of any well known fastening device such as staples, glue, or the like. At this point the hook bases are interior of the corrugated assembly and the hook shaft protrude outwardly and forwardly and at an upward angle of tilt through the slots in the center panel.

The upward tilt enables the hook shaft to compensate for material loading and creep when filled with the hanging packaged product.

The small barb 27 disposed on the lower most edge of the hook base 23 slightly pierces the surface of the folded over rear corrugated wings which helps prevent movement of the hook with respect to its mating slot, especially rotational movement.

Though the invention has been described and illustrated with reference to a preferred embodiment thereof, those skilled in the art will appreciate that various changes and modifications in shape, size, composition, and arrangement of parts may be resorted to without departing from the spirit of the invention or scope of the subjoined claims.

What is claimed is:

1. A merchandise display panel for displaying packaged products comprising:

(a) a center panel;

(b) a pair of spaced apart side wings operatively associated with said center panel and separated by said center panel and each connected to said center panel by means of fold scores;

(c) a plurality of peghook receiving slots formed through said center panel; and (d) a plurality of peghooks disposed through said peghook receiving slots for receiving and holding said packaged product wherein said peghooks comprise a generally horizontally extending shaft terminating at one end with a hook for receiving and holding said packaged product wherein a hook base is operatively disposed at one end of said horizontally extending shaft distant from said hook for holding said peghooks in place in said receiving slots when said side wings are folded along said fold scores backward against the rear of said center panel and said hook base such that said hook base is substantially disposed between said center panel and said side wings.

2. The merchandise display panel of claim 1 wherein said shaft is elliptically shaped.

3. The merchandise display panel of claim 2 wherein said shaft comprises a reinforcing rib.

4. The merchandise display panel of claim 3 wherein said hook base is connected to said horizontally extending shaft by means of an I-shaped connecting structure.

5. The merchandise display panel of claim 4 wherein said hook base comprises:

(a) an upper vertical planar surface;

(b) a lower angular planar surface; and (c) a rearwardly facing barb disposed on a lowermost edge of said lower angular planar surface wherein said barb pierces the surface of one of said side wings when said side wing is folded along said fold score backward against the rear of said center panel and said hook base to prevent movement of said peghook with respect to said slots.

* * * * *